United States Patent [19]

Nijhuis et al.

[11] 4,228,643

[45] Oct. 21, 1980

[54] METHOD FOR THE MANUFACTURE OF TWISTLESS OR SUBSTANTIALLY TWISTLESS YARN

[75] Inventors: Jan Nijhuis, Hengelo; Thomas H. M. Terwee, Enschede, both of Netherlands

[73] Assignee: Hollandse Signaalapparaten B.V., Hengelo, Netherlands

[21] Appl. No.: 963,544

[22] Filed: Nov. 24, 1978

[30] Foreign Application Priority Data

Dec. 1, 1977 [NL] Netherlands ..... 7713263
Apr. 7, 1978 [NL] Netherlands ..... 7803705

[51] Int. Cl.[2] ..... D02G 3/40; D02G 3/04; D01H 13/30

[52] U.S. Cl. ..... 57/297; 57/298; 57/328; 57/329

[58] Field of Search ..... 57/297, 298, 333, 328, 57/329

[56] References Cited

U.S. PATENT DOCUMENTS

| | | | |
|---|---|---|---|
| 2,049,905 | 4/1936 | Gminder | 57/329 X |
| 2,515,299 | 7/1950 | Foster et al. | 57/333 |
| 3,447,310 | 6/1969 | Bok et al. | 57/297 |
| 3,802,174 | 4/1974 | Landwehrkamp et al. | 57/329 X |
| 3,945,186 | 3/1976 | VanDort | 57/298 X |
| 4,051,658 | 10/1977 | Terwee et al. | 57/298 X |
| 4,064,684 | 12/1977 | Nijhuis | 57/298 X |

FOREIGN PATENT DOCUMENTS 1463653 2/1977 United Kingdom .

*Primary Examiner*—John Petrakes
*Attorney, Agent, or Firm*—David R. Treacy

[57] ABSTRACT

In a method for the manufacture of twistless yarn a sliver of staple fibre material is drafted in two drafting zones, which are separated by a neutral zone. The drafting in the first zone occurs in a dry condition and in the second zone in a wet condition. The drafting liquid, which can contain a bonding agent, is supplied to the sliver through a false twister inserted in the neutral zone. This drafting process provides an increased uniformity of twistless yarn in a range of counts of 10–300 tex at a production rate of 300 to 600 m/min.

6 Claims, No Drawings

METHOD FOR THE MANUFACTURE OF TWISTLESS OR SUBSTANTIALLY TWISTLESS YARN

Method for the manufacture of twistless or substantially twistless yarn.

The invention relates to a method for the manufacture of twistless or substantially twistless yarn and to the yarn whenever manufactured by the application of this method. The method comprises the steps of drafting a sliver of staple fibre material in two drafting zones, which are separated by a neutral zone, to form a thinner fibre strand, and of false twisting and bonding the fibre strand.

The Dutch Pat. No. 152.611, to which U.S. Pat. No. 4,051,658 corresponds discloses a method for the manufacture of twistless or substantially twistless yarn from a sliver of staple fibre material to which a potentially adhesive component is added, which sliver is drafted in a wet condition to form a thinner fibre strand, which is subsequently false twisted and bonded. By this method the bonding is realised by activating the potentially adhesive component in the fibre strand through an appropriate combination of moisture and heat and then drying the fibre strand. In the process, as described in the above-cited patent, it was found however that with the drafting of the sliver completely in a wet condition no fine count yarns could be obtained, unless a relatively fine sliver was used and a considerable nonuniformity in the yarn mass was accepted. It was further found that the disclosed method made it still possible to produce a yarn of 20 tex from a sliver, heavier than 1 ktex, at a production rate up to 400 m/min with a nonuniformity which compared unfavourably with the average Uster values specified as standard by the Zellweger Company of Uster (Switzerland). A finer yarn was not obtainable with these parameters; the high drafting speeds required for a finer yarn introduced such a great nonuniformity that frequency breakage occurred. As far as the yarn uniformity is concerned, this could be improved to values which correspond with the average Uster standard values if, following the method described in the Dutch Pat. No. 147.491, to which British Pat. No. 1,463,653 corresponds the drafting fully occurs in a dry condition, thereby reducing the production rate to not less than 150 m/min; it was still impossible to produce a finer yarn.

It is an object of the present invention to provide a method as set foth in the opening paragraph, whereby counts of 10–300 tex with a mass nonuniformity corresponding with the average Uster values are obtained from a relatively coarse sliver at a production rate of 300 to 600 m/min.

According to the invention, the drafting in the first zone occurs in a dry condition and in the second zone in a wet condition.

Since a relatively coarse sliver is used and the drafting factor in the first zone is limited, for instance to a factor 5, it is possible to perform the drafting in this zone in a dry condition; even at high production speeds sufficient bonding between the fibres is retained.

In the subsequent neutral zone the sliver is to be supplied with the liquid required for the wet drafting in the second zone; that is, sufficient liquid that free liquid adheres to the suface of the fibres, in addition to that liquid which is absorbed by the fibres. This is preferably carried out with a liquid false twister. Through the liquid eddies produced around the sliver passing through the false twister, liquid is supplied to the sliver, while a false twist is imparted to the sliver; this facilitates bridging of the neutral zone, which will generally be longer tnan the fibre length.

In the second drafting zone the sliver is drafted in a wet condition. As the wet-drafting is known from the Dutch Pat. No. 143.002, to which U.S. Pat. No. 3,447,310 corresponds, this needs no further explanation.

Through the insertion of a false twister in the neutral zone, offering the possibility to add a bonding agent to the sliver simultaneously with the drafting liquid, the invention is not confined to a method for the manufacture of twistless or substantially twistless yarn from a sliver of staple fibre material to which a potentially adhesive component is added. Therefore, as concerns the present invention, it is not necessary to add a potentially adhesive component to the sliver prior to the drafting process. Moreover, the bonding agent supplied via the false twister, may consist of an active or an inactive adhesive, i.e. a potential adhesive. The insertion of a liquid false twister in the neutral zone thus offers on the one hand the average that, through the combined dry- and wet-drafting, a great uniformity is obtained over a wide range of yarn counts even at high production speeds and, on the other hand, the advantage that various bonding agents can be added to the sliver prior to the wet-drafting process.

The bonding agent may be supplied to the sliver in the form of an adhesive solution, dispersion, suspension or emulsion. Suitable adhesives soluble in water, either active or inactive, are: polyvinyl alcohol, starch and starch derivatives, methyl cellulose, hydroxypropylmethyl cellulose derivatives, hydroxyethyl cellulose, carboxymethyl cellulose, polyvinylpyrrolidone, polyacrylates (homologues of polyacrylic acid) and polyethylene oxides. Besides these, the adhesives referred to in U.S. Pat. No. 4,051,658 (alginates and cellulose di- and tri-acetates soluble in organic solvents) are of course still usable, although their use is less economical.

If the above water-soluble adhesives are applied in active form, it is preferable to pass the sliver through a condenser, through which water is flowing, before feeding through the wet drafting zone. In this way it is achieved that the sliver saturated with water containing the bonding agent is enveloped by an adhesivefree water film, reducing the tendency of the sliver fibres to stick to the rollers of the draw frame.

If the absorption of the adhesive suspension and emulsion via the false twister in the already twisted sliver happens to be inadequate through the size of the particles in the suspension or emulsion, the bonding agent can be supplied to the sliver after the dry-drafting process, but before false-twisting in the neutral zone. In practice, this will lead to the introduction of an additional pair of rollers in the section of the neutral zone in question, where the suspension or emulsion is added to the sliver at the feed-in of these rollers.

In so far the above bonding agents are applied in an inactive form, the fibre strand obtained after drafting may be further processed as described in U.S. Pat. No. 4,051,658. If however these bonding agents are applied in active form, the processing of the fibre strand after drafting may be confined to false twisting and drying; the bonding of the fibre strand is realised by drying only, e.g. on a heated drum.

EXAMPLE 1

A sliver of 2.95 ktex, 90% of which consisting of cellular fibres of 1.7 dtex and 40 mm and 10% of polyvinyl alcohol (PVA) fibres of 1.6 dtex and 40 mm, was passed through the first drafting zone in a dry condition with a drafting factor 5 to form a sliver of 590 tex. The fibre material was then saturated with water by means of a false twister inserted in the neutral zone, and was admitted into the second drafting zone. In a number of consecutive measurements the fibre material was subjected in the second zone to the drafting factors listed in the table below. The sliver so drafted was finally false twisted; then water was reintroduced, the PVA in the sliver was activated on a heated drum, and the fibre material was dried. The process steps after drafting were irrelevant to the mass-nonuniformity measurements listed below. The first column of the table below lists the drafting factors in the second zone, the second column the weights per unit length of the twistless yarn obtained after drafting, activation and drying, and the third column the production speed at which the twisted yarn was obtained. The following three columns give the measured Uster values of the yarn under the various conditions to which the yarn was subjected. Uster standard values normally refer to a "round" (twisted) yarn. The twistless yarn however, has a flat cross section. Small twists of such a flat fibre strand are considered as nonuniformities in the measurements of Uster values. The Uster values of the twistless yarn, which was unwound tangentially, were therefore too high as to correspond with the actual nonuniformity; these values are listed in the fourth column.

The above shows that a better result would be obtained if the twistless yarn were twisted after all; the then obtained Uster values would be a better representation of the actual nonuniformity than in the situation described above. The Uster values of the twisted "twistless yarn" are given in the fifth column.

A uniform mass distribution in the yarn is by itself no object; however, it is required that the fibres in the fabric manufactured from the twistless yarn do show a uniform mass distribution. As described in the above-mentioned Dutch patents, the PVA is removed from a fabric manufactured from twistless yarn in the finishing process of the fabric. Hence, mass nonuniformity measurements should have been taken on twistless yarn from which the PVA had been removed; this was however impossible. It was possible to remove the PVA from the twisted "twistless yarn"; the imparted twist provided for sufficient cohesion between the fibres to take measurements on nonuniformity of this yarn. The results thereof are listed in the sixth column. The Uster values in this column are the best representation for the twistless yarn in its specific application in fabric from which the PVA is removed and are as such comparable with the Uster standard values for twisted yarns. The measurements performed here do not only demonstrate the possibility of manufacturing very fine twistless yarn at extremely high speeds, but also show that the yarn possesses a particularly good uniformity.

| Drafting factor second drafting zone | Tex number of the twistless yarn | Production speed of the twistless yarn in m/min. | Uster values of the twistless yarn unwheeled tangential | Uster values of the twisted "twistless yarn" | Uster values of the twisted "twistless yarn" without PVA |
|---|---|---|---|---|---|
| 10 | 59.0 | 600 | 11.0 | 11.4 | 10.7 |
| 16 | 36.9 | " | 12.2 | 11.8 | 11.1 |
| 20 | 29.5 | " | 14.1 | 11.2 | 10.4 |
| 24 | 24.6 | " | 13.9 | 11.6 | 10.7 |
| 30 | 19.7 | 500 | 14.5 | 13.5 | 12.4 |
| 36 | 16.4 | 400 | 16.2 | 15.2 | 13.8 |
| 40 | 14.8 | " | 18.2 | 15.8 | 14.2 |
| 45 | 13.1 | 300 | 15.6 | 15.3 | 13.6 |
| 51 | 11.6 | " | 17.8 | 17.1 | 15.1 |

EXAMPLE 2

A sliver of 2.95 ktex, consisting of combed cotton fibres having average staple length of 32 mm, was passed through the first drafting zone in a dry condition with a drafting factor of 5 to form a sliver of 590 tex. By means of a false twister inserted in the neutral zone the fibre material was wetted with an aqueous solution of an adhesive on the basis of a copolymer of ammonium salt of acrylic acid. Before entry into the second drafting zone, the sliver thus wetted was passed through a condenser through which water was flowing. In this way the sliver was enveloped by a water film, thereby reducing the tendency of the fibres in the sliver to stick to the rollers of the draw frame. The sliver was subsequently wet-drafted with a drafting factor of 12, false twisted, dried on a drum heated to 200° C., and finally wound on a reel at a speed of 350 m/min. The yarn so obtained had a titre of 49 tex, a yarn strength of 7.4 gm/tex and a yarn uniformity expressed in the Uster value of 11.8 of the yarn unwound tangentially. This yarn produced a fabric in which the adhesive could be washed out quite easily.

We claim:

1. Method for the manufacture of twistless or substantially twistless yarn from a sliver of staple fibre material, including the sequential steps of:
   - dry-drafting the sliver in a first drafting zone,
   - false twisting and wetting the drafted sliver by means of a first false twister to which a liquid is supplied, whereby the liquid content of the sliver is brought to at least 80% by weight,
   - drafting the wetted sliver in a second drafting zone to form a thinner fibre strand,
   - false twisting the fibre strand by means of a second false twister, and
   - bonding the fibres of the fibre strand.

2. Method for the manufacture of twistless or substantially twistless yarn from a sliver of staple fibre material, including the sequential steps of:
   - drafting the sliver in a first drafting zone in a dry condition,
   - false twisting and wetting the drafted sliver by means of a first false twister to which a liquid is supplied sufficient that free liquid remains adhering to the surface of the fibres,
   - wet drafting the wetted sliver in a second drafting zone to form a thinner fibre strand,
   - false twisting the fibre strand by means of a second false twister, and
   - bonding the fibres of the fibre strand.

3. Method for the manufacture of twistless of substantially twistless yarn as claimed in claim 1 or 2, characterized in that the liquid, supplied to the sliver through the first false twister, contains a bonding agent.

4. Method for the manufacture of twistless or substantially twistless yarn as claimed in claim 3, whereby the bonding agent, activated in an aqueous medium, is added to the sliver, characterised in that, before entry of the sliver into the second drafting zone, said sliver is passed through a condenser, through which water is flowing, to envelop the sliver saturated with water containing the bonding agent with an adhesive-free water film.

5. Method for the manufacture of twistless or substantially twistless yarn as claimed in claim 1 or 2, characterised in that a bonding agent is added to the sliver after the dry-drafting process but before the false-twisting by the first false twister.

6. Method for the manufacture of twistless or substantially twistless yarn as claimed in claim 5, whereby the bonding agent, activated in an aqueous medium, is added to the sliver, characterised in that, before entry of the sliver into the second drafting zone, said sliver is passed through a condenser, through which water is flowing, to envelop the sliver saturated with water containing the bonding agent with an adhesive-free water film.

* * * * *